United States Patent [19]

Mowry, Jr. et al.

[11] 4,406,389

[45] Sep. 27, 1983

[54] HIGH SPEED WEB PROCESSING UNIT ADJUSTABLE TO VARIABLE LENGTH DOCUMENTS

[75] Inventors: William H. Mowry, Jr., Ionia; Michael J. Poccia, Rochester, both of N.Y.

[73] Assignee: Burroughs Corporation, Detroit, Mich.

[21] Appl. No.: 272,585

[22] Filed: Jun. 11, 1981

[51] Int. Cl.[3] ..... B65H 23/18

[52] U.S. Cl. ..... 226/29; 226/40

[58] Field of Search ..... 226/27–32, 226/40, 2; 270/50, 52; 74/674, 675

[56] References Cited

U.S. PATENT DOCUMENTS

| | | | |
|---|---|---|---|
| 3,312,126 | 4/1967 | Hering, Jr. | 74/675 |
| 3,556,509 | 1/1971 | Crum | 270/52 |
| 3,768,715 | 10/1973 | Tout | 226/40 |
| 4,007,866 | 2/1977 | Traise | 226/31 |
| 4,129,238 | 12/1978 | Herd | 226/29 |

*Primary Examiner*—Leonard D. Christian

*Attorney, Agent, or Firm*—D. G. Rasmussen; K. R. Peterson; E. M. Chung

[57] ABSTRACT

The apparatus is an improved web processor, which operates at a high web speed, and can achieve variable document lengths with only programmable changes. To achieve this result the web processor uses an improved tool and web drive control. The tool control insures that the tool contacts the web once per document length. The web drive control varies the web speed to mate with the tool during impact and then speed up or slows down the web to maintain a constant speed throughout the processing unit.

12 Claims, 7 Drawing Figures

FIG. 3
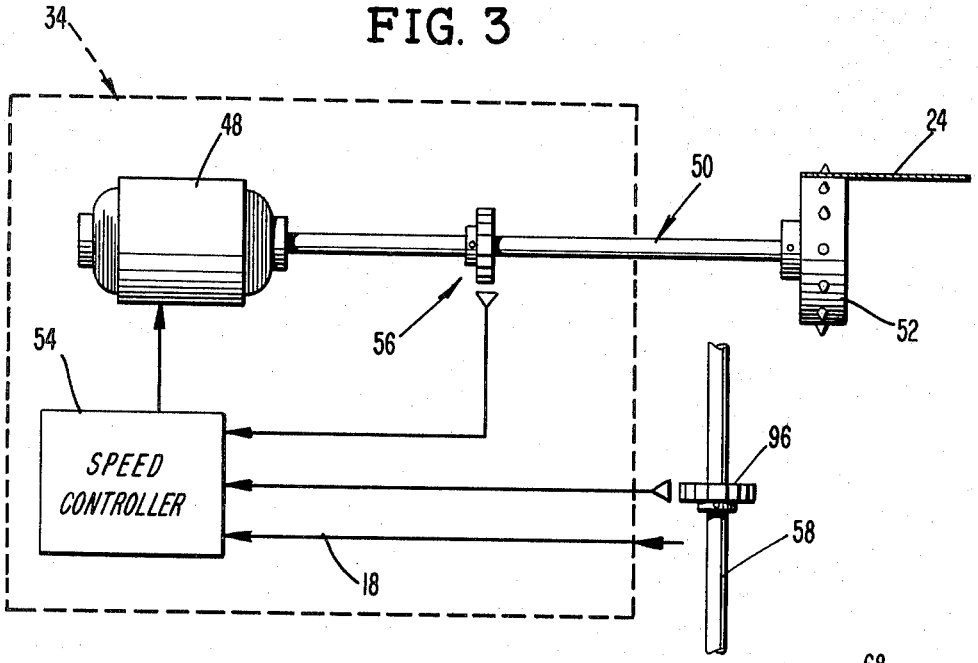
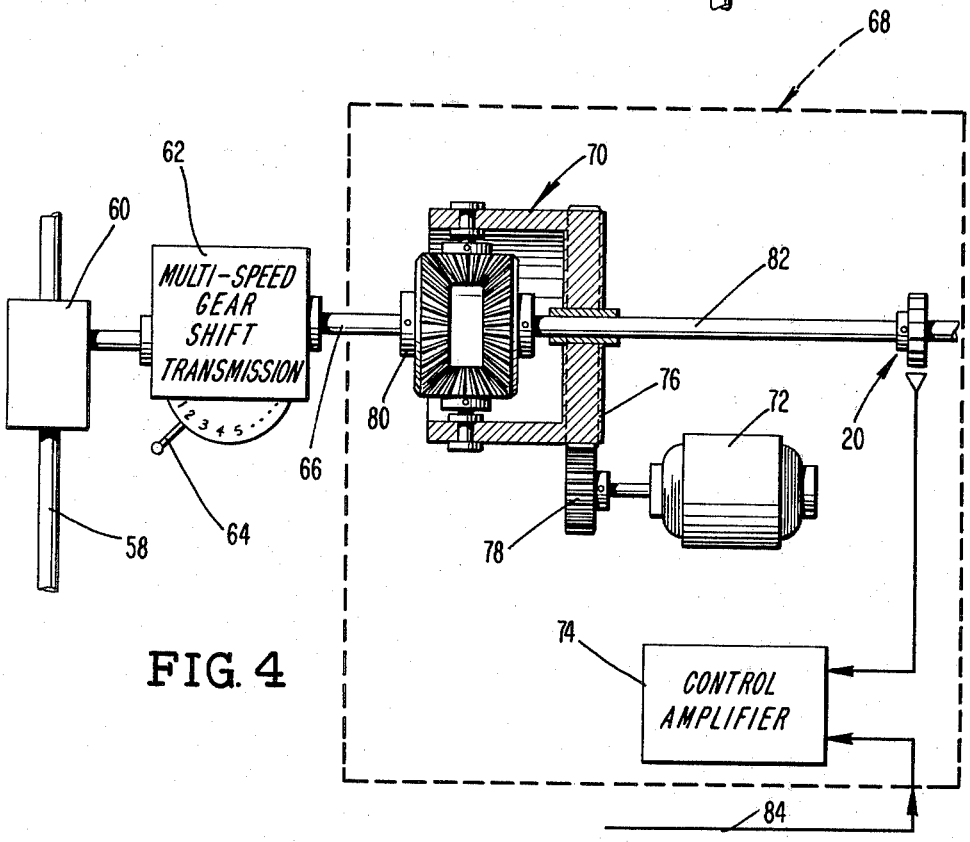
FIG. 4

HIGH SPEED WEB PROCESSING UNIT ADJUSTABLE TO VARIABLE LENGTH DOCUMENTS

BACKGROUND OF THE INVENTION

1. Field of the Invention

The present invention relates in general to web processing units, and in specific, to web processing units capable of processing variable document lengths, at high web speed, with a simple programmable adjustment.

2. Description of the Prior Art

The present method of achieving variable document length on high speed printers, capable of handling a web speed of 500 to 1500 feet per minute, is to physically change their operating cylinders or rings. A cylinder or ring having a particular circumference or having a particular number of processing tools around the circumference must be installed for each desired document length. This cylinder or ring must then be replaced for each change in document length.

Other web processors known in the art use intermittent web motion with variable tool stroke through part of the press and constant web speed in the other parts. However, these presses are relegated to slow speed operation due to their intermittent motion. Other models use intermittent variable stroke web motion. This method is intrinsically slow and unsuitable to volume production of documents.

This invention corrects the shortcomings of the prior art methods, enabling documents of various lengths to be processed, at high speed, with only programmable changes. The web processor can rapidly and automatically be adjusted and accommodated to various document lengths.

SUMMARY OF THE INVENTION

The present invention resides in an improved web processing unit. A web is driven at a constant speed into and out of a processing unit where it is impacted by a processing tool. The motion of the processing tool is controlled by an adjustable ratio driver so that its cycle of rotation is one revolution per document. A web accumulator preceeds and follows the processing tool and provides an area in the processing unit where the web is independently driven by a web speed modulator. The web speed in this area between the accumulators is matched to the tool tangential speed when the tool intercepts the web and is then modified (increased or decreased) so that the overall speed of the web into and out of the processing unit is maintained.

A novel feature of this invention is the unique method of adjusting the tool impact cycle and controlling the variable web speed in the area of the tool. This enables a web moving into and out of the processing unit, at a high constant speed, to be processed for documents of various lengths. Another novel feature of this invention is the independent web speed control in the processing unit. This enables the web to be slowed down or speeded up to mate with the processing tool and then modified to match the constant web input to the processing unit. Another novel feature of this invention is the use of an adjustable ratio drive for speed and register control of the processing tool. This adjusts the tool's cycle to impact the web at the correct location at least once per document.

BRIEF DESCRIPTION OF THE DRAWINGS

FIG. 3 is a block diagram of the web speed modulator.

FIG. 4 illustrates, in block diagrammatic form, an embodiment of the adjustable ratio driver.

DETAILED DESCRIPTION OF THE PREFERRED EMBODIMENT

Figure 1:
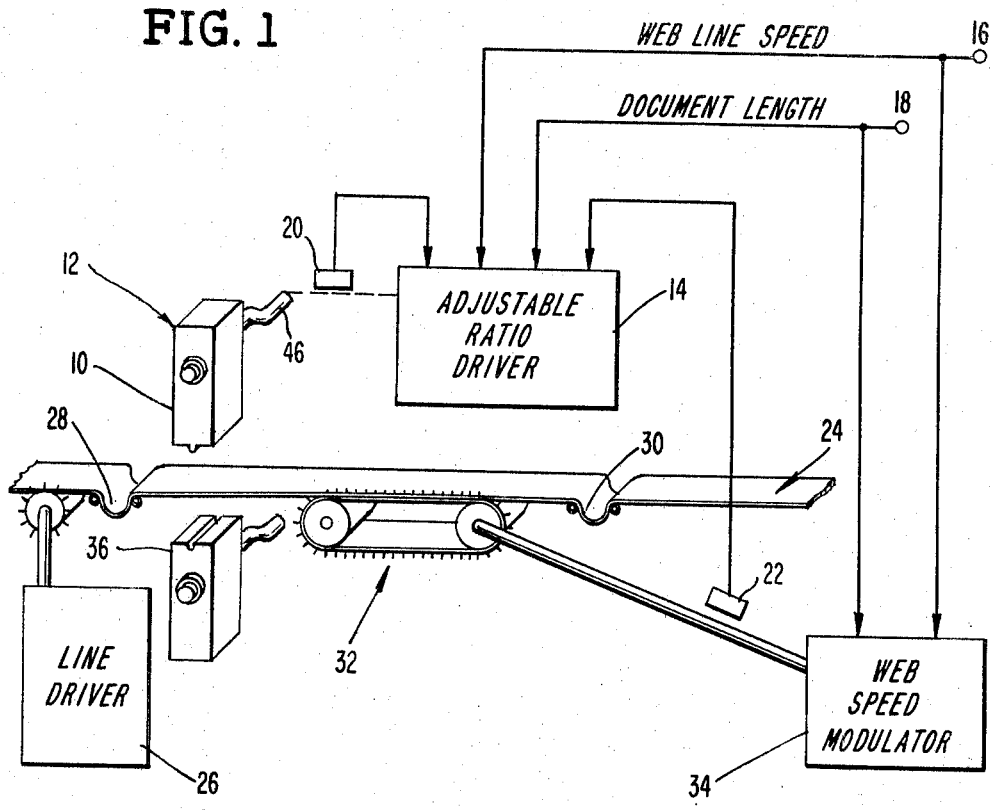
FIG. 1 is a block diagram of the invented web processor.

The apparatus for this web processing unit is outlined in block diagrammatic form in FIG. 1. The apparatus is generally composed of: a processing tool 10 such as a punch, imprinter, numbering machine, or similar device, which is mounted as the coupler link in a parallelogram linkage 12, whose crank length is such that one crank revolution moves the tool, tangentially, a distance equal to the shortest document to be accommodated (other sizes are possible); an adjustable ratio driver 14 connected to the parallelogram linkage 12 receives as inputs web line speed 16 from an encoder, document length 18, and tool and web position 20, 22 information from encoders, and drives the linkage at one revolution per document and also provides register control; a web 24 which is driven by a line driver 26 into and out of the processing unit at a constant line speed runs through two web accummulators 28, 30 located on either side of the processing tool 10, which allows the speed of the web in the area between the accummulators to be independently driven by one or more pin tractors 32, which is powered by a web speed modulator 34; a mating tool 36, such as a die or anvil, is a optional "back-up" to the processing tool 10, and is driven similarly to the processing tool, but in a "mirror image" manner. In this apparatus, the tangential speed of the processing tool 10 may be set to equal the constant line speed when the shortest document is being processed. Note that other document lengths could be selected to run synchronously. This could require the web to speed up to match the tool speed for some sizes, run synchronously for one size, and slow down for other sizes. For documents other than those of the synchronized document length, the tool tangential speed is equal to the mean web speed times the ratio of the synchronized document length to the processed document length. Since during impact the tangential speed of the tool and the web must be equal to avoid tearing, the web between te accummulators must be matched to the tool tangential speed. The web speed modulator 34 performs this cyclic drive function, receiving as inputs the document length 18 and the web line speed 16.

Figure 2:
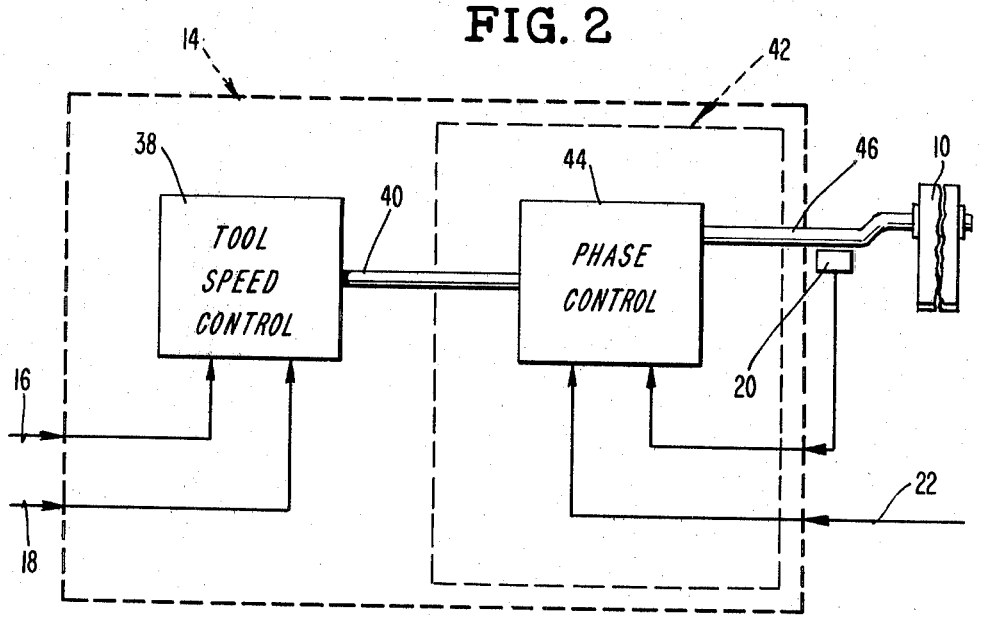
FIG. 2 is a block diagram of the adjustable ratio driver.

FIG. 2 shows a more detailed block diagram of the adjustable ratio driver 14 showing both its function as a tool driver and as a close running register control. The tool speed control 38, takes as inputs the web line speed 16, and the document length 18, and provides as an output the shaft 40, turning at the rate of one document per revolution. Close running register control 42 is accomplished by a phase controller 44 in association with the speed controller 38. The phase controller 44 receives as inputs web position 22 and tool shaft position 20, and adjusts the phase of the output shaft 46 such that the impact of the processing tool 10 and the web occurs at the precise location.

FIG. 3 shows a more detailed block diagram of the web speed modulator 34. A DC servo motor 48 is connected by a tractor shaft 50 to the web tractor pins 52 and drives the web in a controlled fashion. A speed controller 54, which contains control circuits common in the art, controls the DC servo motor 48 and receives as inputs: electrical impulses from a tractor shaft encoder 56 indicating web position; electrical impulses from a line shaft encoder 58 which indicates the web line speed; and document length 18. In operation the speed controller 54 must either: (a) compute from the input data the desired tractor shaft speed profile; or (b) have stored in memory the desired tractor speed profile for each web line speed and document length. The profile indicates to what speed, and when, the web within the web accummulators must be driven in order to match the processing tool 10's tangential speed during impact. It indicates to what speed the web must then be brought to match the web line speed for each full document cycle. From this profile the speed controller 54 sends control signals to the servo motor 48 to produce the desired tractor speed. The signal from the tractor shaft encoder 56 is used in a feedback loop to compare actual with desirable tractor shaft speed at any given time. As an option the register control included in the adjustable ratio driver could be included rather in the web speed modulator. This would involve adding an input to the speed controller 54 from the tool shaft encoder (20, FIG. 1), comparing it to the signal from the tractor shaft encoder 56 and generating the proper control voltage.

FIGS. 4, 5, 6 and 7 show various physical embodiments for the adjustable ratio drive (14, FIG. 1). In one embodiment, shown in FIG. 4, driving power is obtained from the line shaft 58 through a right angle drive 60. A multi-speed gear shift transmission 62, having one speed for each document length, is connected to the right angle drive 60. The multi-speed gear shift transmission 62 uses the line shift 58 as the web line speed input and the position of the gear selector 64 as the document length input. As an output the multiple gear shift transmission 62, produces a shaft 66 rotation of one revolution per document. This shaft 66 is connected to a register control arrangement 68 which consists of a differential gear box 70 (such as commercially available for register control application), and a servo motor 72 and its attended control amplifier 74. The servo motor 72 drives the control shaft 74 by turning a ring gear 76 through a gear 78. The transmission output shaft 66 turns another differential shaft 80. The third differential shaft 82 is connected to the processing tool 10 drive shaft. As a result, the tool drive shaft 82 turns at one revolution per document, subject to register control. The control amplifier 74, which contains control circuits common in the art, takes as input signals from the tractor shaft encoder 84, which supplies web position information; signal from a tool drive shaft encoder 20, which supplies tool position information. The control amplifier 74 compares these inputs and drives the servo motor 72 so as to reconcile these two inputs. The resulting output controls the process tool 10 such that one tool revolution occurs for each document, and such that the processing tool impacts the web at the precise location.

Figure 5:
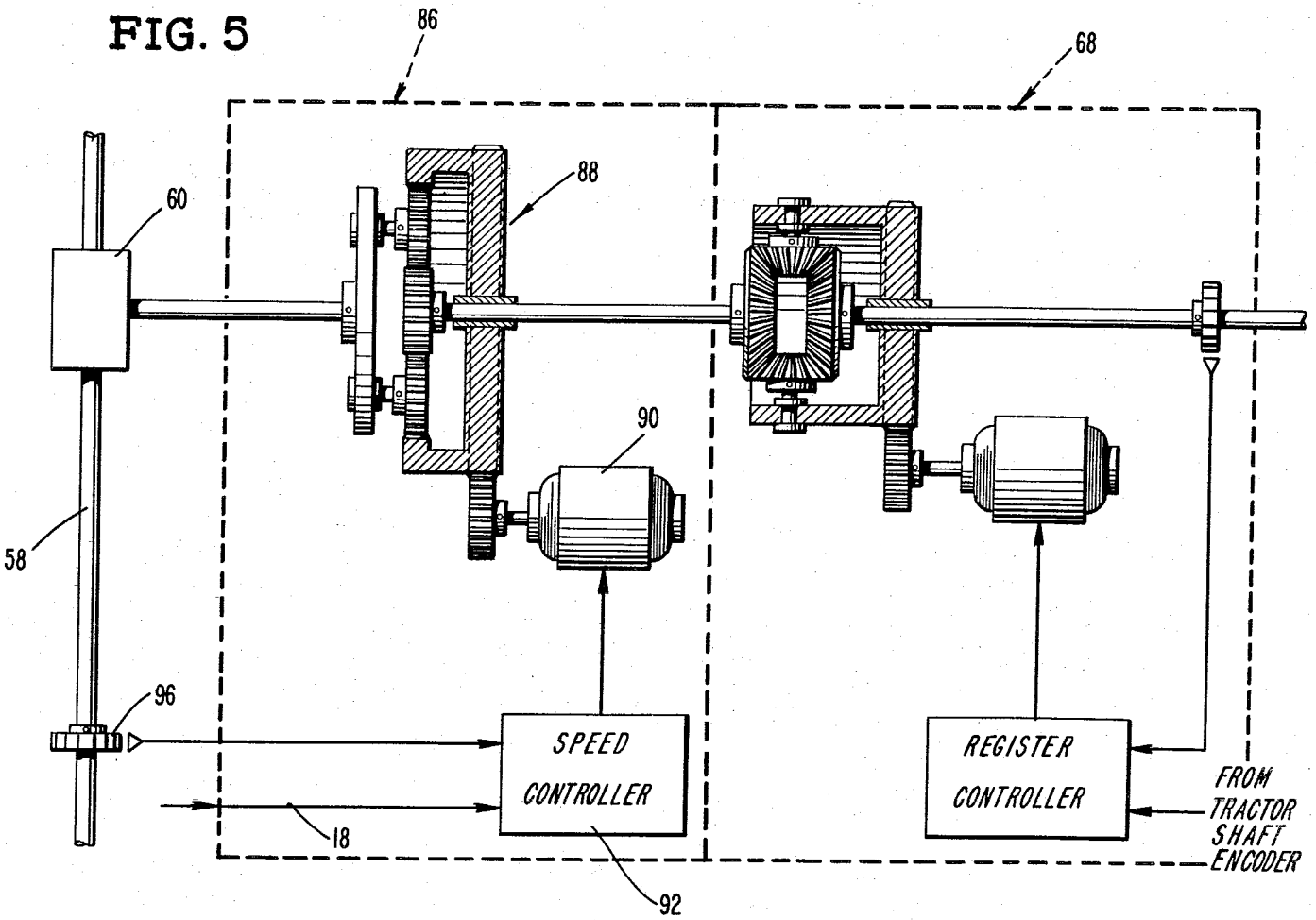
FIG. 5 is a block diagram showing an additional embodiment of the adjustable ration driver where all drive power comes from the line shaft.
Figure 6:
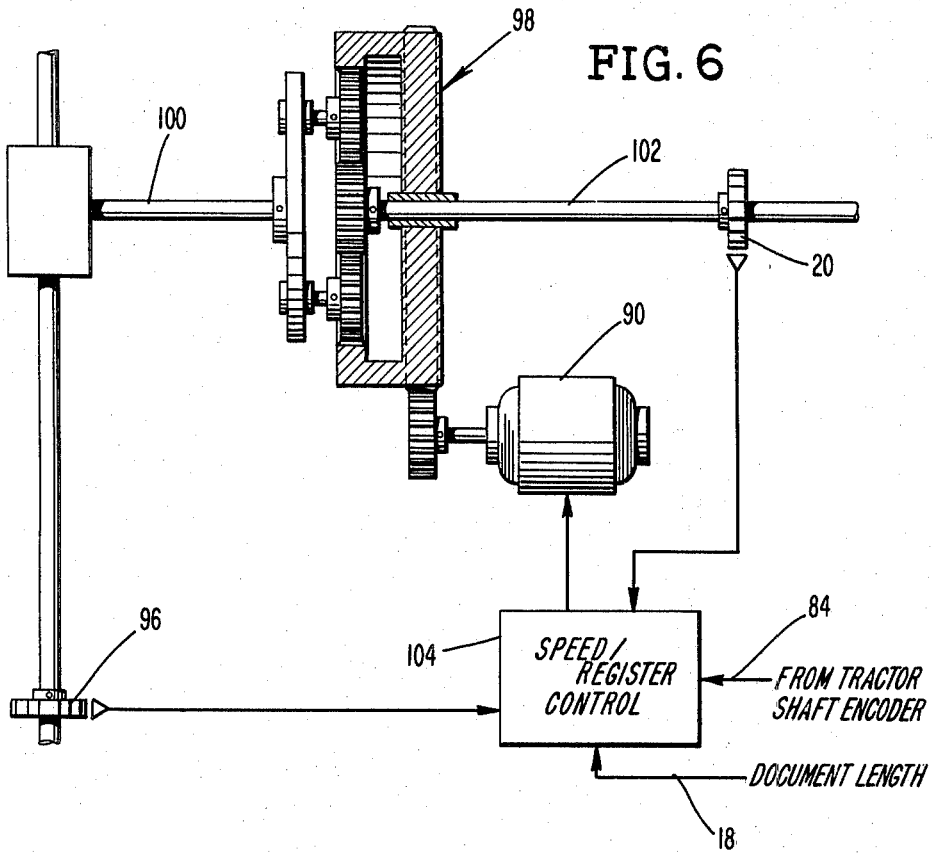
FIG. 6 is a block diagram showing an embodiment for the adjustable ratio driver in which both speed and register control are combined.

FIG. 5 shows an additional embodiment of the adjustable ration driver. In this embodiment, a speed controller 86 replaces the gear shift transmission 62 and gear selector 64 of FIG. 4 and is composed of planetary gear set 88, a speed control motor 90 and a speed controller 92. The planetary gear 88 receives primary drive from the line shaft 58 through a right angle drive 60 and secondary control input from the speed control motor 90. The speed control motor 90 is controlled by the speed controller 92 such that the output shaft 94 speed is constant for a given document length. The speed controller 92, which contains control circuits common in the art, receives as input signals from a line shaft encoder 96 which suppliers the line shaft revolution information and information concerning document length 18. The speed controller 92 produces as output a control signal which assures a set output shaft revolution for each document length. The register control 68, shown in FIG. 5, is identical in function and design to the one shown in FIG. 4 and previously discussed.

As an alternative to the register control 68, shown in FIG. 4, the register control could be incorporated into the speed control apparatus 86. In this alternate embodiment, shown in FIG. 6, the control motor 96 operating through the planetary gears 98, produces both speed and phase modulation of the input shaft 100 to produce an output shaft 102 rotation which directly drives the processing tool. The controller circuit 104, would be of common design known in the art, and would receive input signals from the line shaft encoder 96, the output shaft encoder 20 and the tractor shaft encoder 84, as well as document length information 18. As an output, it would supply control signals to the control motor 90 such that the output shaft 102 would rotate at the desired speed for each document length (one revolution per document) and such that the phase of rotation would be adjusted for precise impact of the processing tool on the web.

Figure 7:
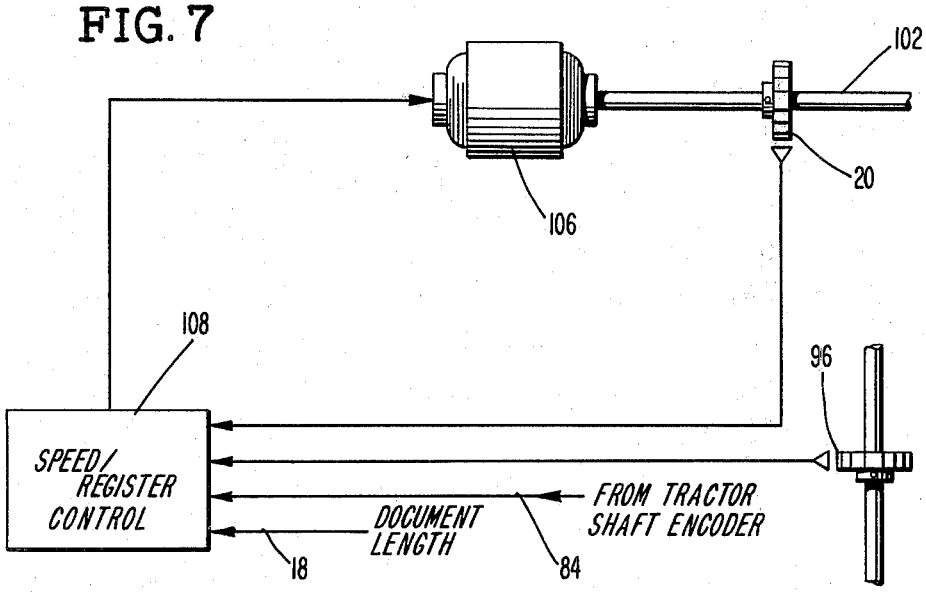
FIG. 7 is a block diagram of an additional embodiment of the adjustable ratio driver where speed and register control is obtained from a single motor.

FIG. 7 shows an additional embodiment of the adjustable ratio driver (14, FIG. 1) in which all mechanical power for register and speed control would be provided by one motor. The motor 106 receives control signals from the speed/register controller 108, and directly drives the tool shaft 102. Speed/register controller 108, which contains circuits common in the art, receives as input: signals from the tool shaft transducer 20 and a tractor shaft encoder 84 to maintain register control; document length information 18 and signals from a line shaft transducer 96 to maintain speed control. There are several possible specific embodiments for the register/speed controller 108. One embodiment would use a servo motor 106, and an AC generator as the line shaft encoder 96. The speed control would be accomplished by frequency multiplication or division, depending on the document length, of the AC signal from the line transducer. Register control would be accomplished by modulating the output control frequency by a voltage determined by registration error (i.e. difference between encoder on the tractor and line drive shaft). This method is analogous to frequency modulation of a carrier by intelligence in the communications field. The speed control output frequency is the analogue to the carrier, and the register control signal is the analogue of the transmitted intelligence.

Another embodiment would involve a DC servo motor as the motor 106. Here, frequency data from the line shaft transducer 96 would be used to drive the DC servo motors. Register control would be accomplished by adding to or subtracting from the speed control output voltage.

In operation, the adjustable ratio driver 14 (FIG. 1), assures that the processing tool shaft 12 rotates at one revolution per document and that the tool 10 impacts each document length on the web at precisly the correct location. For the nominal document length, the working circumference of the tool is such that at one tool revolution per document, the tangential tool speed equals the constant web line speed. For longer document length, the tangential tool speed would be less than the line web speed. The web speed in the vicinity of the process tool and between the web accummulators 28, 30, must be varied to match tool tangential speed while contact is made. The web must then be driven so that the mean web speed is maintained through each full document cycle. This web speed control is provided by the web speed modulator 34. Areas of slackened web storage, provided by the web accummulators 28, 30 proceed and follow the modulated portion of the web and allow a constant web speed to be maintained throughout the rest of the web processing unit.

Prior art web processing units required one to either physically change the operating cylinders and rings or required "stop-go" type web or tool motion which resulted in low speed processing, unsuited to volume production of documents. This invention enables documents of various lengths to be produced by a web processor at high speed (around 1,000 ft. per minute) with the simple change of one parameter—document length 18.

What is claimed is:

1. In a web processing unit, which adjusts to variable document lengths, a web is moved by a line driver into and out of the processing unit at a constant rate of speed, the web processing unit having a processing tool, said processing unit comprising:

a coupler linkage connected to said processing tool such that the tool impacts the web while moving parallel to said web;

an adjustable ratio driver, connected to said coupler linkage to drive the tool at one impact per document using as inputs the webs constant line speed and the document length and to provide close running register control by adjusting the phase of the driver shaft;

web accummulators, located on either side of said processing tool, to allow the web to travel at said constant line speed outside of said web accummulators, while the speed between the accummulators varies cyclicly;

a web speed modulator to drive the web, in the area between said web accummulators, in such a manner that the speed of the web is matched to the tool impact speed when the tool impacts the web and then varied such that the overall web speed between said web accummulators equals the speed with which the web is driven into and out of said web processing unit.

2. In a web processing unit, which adjusts to various document lengths, a web is moved by a line driver into and out of the processing unit at a constant rate of speed, the web processing unit also having a processing tool, said processor unit comprising:

a coupler linkage connected to said processing tool such that the tool impacts the web while moving parallel to said web;

an adjustable ratio driver, connected to said coupler linkage, to drive the tool at one impact per document using as inputs the constant web line speed and the document length;

web accummulators, located on either side of said processing tool, to allow the web to travel at said constant line speed outside of said web accummulator, while the speed between the accummulators varies cyclicly;

web speed modulator, to drive the web, in the area between said web accummulators, in such a manner that the speed of the web is matched to the tool tangential speed when the tool impacts the web and then varied such that the overall web speed between said web accummulators equals the speed with which the web is driven into and out of said web processing unit, and to provide close running register control by adjusting the phase of said web speed modulator during the period of the cycle when the tool is free from impact with the web.

3. The apparatus of claim 1 in which said web speed modulator comprises:

a web tractor to drive the web between said web accummulators;

a DC servo motor connected to said web tractor, to drive the web in a controlled manner;

a first encoder coupled to the output of said web tractor to measure the speed of the web between said accummulator;

a second encoder coupled to the output of said line driver to measure the constant speed of the web outside of the accummulators;

a speed controller circuit receiving as inputs document length and signals from said first and second encoders and producing a control signal output to said DC servo motor such that the web between said accummulators is matched to the tool tangential speed when the tool impacts the web and then varied such that the overall web speed between said web accummulators equals the speed with which the web is driven into and out of said web processing unit.

4. The apparatus of claim 1 in which said adjustable ratio driver comprises:

a tool speed control with an output shaft, said tool speed control receiving as inputs web line speed and document length and producing as an output a shaft rotation of one revolution per document;

a phase control, coupled between said speed control output shaft and said tool linkage said phase control receiving as inputs tool and web position and modulating the phase of said speed control shaft such that the tool linkage is driven at one impact per document and impacts the web with precise register.

5. The apparatus of claim 1 in which said adjustable ratio driver comprises:

a line shaft, connected to said line driver, which supplies driving power;

a multi-gear shift transmission, connected to said line shaft, said transmission having an output coupler and having several gear shift settings for each document length, which are selected such that the output coupler will rotate at one revolution per document;

a differential phase adjuster, having a first differential coupler connected to said output coupler of said multi-gear shift transmission, a second differential coupler connected to a servo motor and a third differential shaft connected to said tool coupler linkage;

a servo motor, connnected to said differential phase adjuster, used to increase or decrease the phase of said differential phase adjustor's third differential shaft;

a tractor shaft encoder, coupled to the output of said web speed modulator, and supplying web information to the control amplifier;

a tool shaft encoder, located on said differential phase adjustor's third differential shaft, to supply tool position information;

a control amplifier, receiving as inputs signals from said tool and tractor shaft encoders, and supplying control signals to said servo motor such that the tool impacts the web with precise register.

6. The apparatus of claim 1, in which said adjustable ratio driver comprises:

a line shaft, connected to said line driver, which supplies driving power;

a line shaft encoder, located on said line shaft, which indicates line shaft rotation;

a planetary gear set, receiving primary drive from said line shaft, secondary control drive, and producing a resulting output drive;

a speed control motor, supplying control drive to said planetary gear set;

a speed controller, receiving as inputs document length and signals from said line shaft encoder and producing a control signal output to said speed control motor such that said planetary gear output rotates at one revolution per document;

a differential phase adjuster, with one differential coupled to the output drive of said planetary gear set, another differential shaft receiving register control, and a third differential shaft connected to said tool coupler linkage;

a register control motor, connected to said differential phase adjuster to supply register control, is used to increase or decrease the phase of said differential phase adjustor's third differential shaft;

a tractor shaft encoder, coupled to the output of said web speed modulator and supplying web position information to the control amplifier;

a tool shaft encoder, located on said differential phase adjustor's third differential shaft, to supply tool position information;

a control amplifier, receiving as inputs signals from said tool and tractor shaft encoders, and supplying control signals to said register control motor such that the tool impacts the web with precise register.

7. The apparatus of claim 1, in which said adjustable ratio driver comprises:

a line shaft, connected to said line shaft driver, which supplies driving power;

a line shaft encoder, located on said line shaft, which indicates line shaft rotation;

a planetary gear set, receiving primary drive from said line shaft secondary drive control and producing a resulting output to drive said processing tool;

a speed/register control motor, supplying control drive to said planetary gear set;

a tool shaft encoder, coupled to said planetary gear output to supply tool position information;

a speed/register controller, receiving as inputs document length and signals from said tool shaft encoder, said line shaft encoder, and said tractor shaft encoder, and producing a control signal output to said speed/register control motor such that said planetary gear set output rotates at one revolution per document and such that said processing tool impacts said web at the precise location.

8. The apparatus of claim 1, in which said adjustable ratio driver comprises:

a speed/register motor, which is connected to and directly drives said coupler linkage;

a line encoder, connected to said line driver, which indicates the web speed into and out of said processing unit;

a tool shaft encoder, coupled to said speed/register motor's output to supply tool position information;

a tractor shaft encoder, coupled to said web speed modulator and supplying web position information;

a speed/register controller, receiving as inputs document length and signals from said tool shaft encoder, said line shaft encoder, and said tractor shaft encoder, and producing a control signal output to said speed/register motor such that said speed/register motor's output rotates at one revolution per document and such that said processing tool impacts said web at the precise location.

9. The apparatus of claim 2, in which said web speed modulator comprises:

a web tractor to drive the web between said web accummulators;

a DC servo motor connected to said web tractor, to drive the web in a controlled manner;

a first encoder coupled to the output of said web tractor to measure the speed and position of the web between said accummulators;

a second encoder coupled to the output of said line driver to measure the constant speed of the web outside of the accummulators;

a third encoder coupled to the output of said parallelogram coupler linkage, to supply tool position information;

a speed/register controller, receiving as inputs document length and signals from said first, second and third encoders and producing a control signal output to said DC servo motor such that; (1) the web between said accummulators is matched to the tool tangential speed when the tool impacts the web and then varied such that the overall web speed between said web accummulators equals the speed with which the web is driven into and out of said web processing unit, and (2) the web is positioned such that said processing tool impacts said web at the precise location.

10. In a web processing unit, which adjusts to various document lengths, a web is moved by a line driver into and out of the processing unit at a constant rate of speed, the web processing unit also having a processing tool, said processor unit comprising:

a coupler linkage connected to said processing tool such that the tool impacts the web while moving parallel to said web;

an adjustable ratio driver, connected to said coupler linkage, to drive the tool at one impact per document using as inputs the constant web line speed and the document length;

web accummulators, located on either side of said processing tool, to allow the web to travel at said constant line speed outside of said web accummulator, while the speed between the accummulators varies cyclicly;

web speed modulator, to drive the web, in the area between said web accummulators, in such a manner that the speed of the web is matched to the tool tangential speed when the tool impacts the web and then varied such that the overall web speed between said web accummulators equals the speed with which the web is driven into and out of said web processing unit.

11. In a web processing unit, which adjusts to variable document lengths, a web is moved by a line driver into and out of the processing unit at a constant rate of speed, the web processing unit having a printing device with a print head, said processing unit comprising:

an adjustable ratio driver, coupled to said printing device to drive the print head at one impact per document using as inputs the webs constant line speed and the document length;

web accummulators, located on either side of said processing tool, to allow the web to travel at said constant line speed outside of said web accummulators, while the speed between the accummulators varies cyclicly;

a web speed modulator to drive the web, in the area between said web accummulators, in such a manner that the speed of the web is matched to the tool impact speed when the tool impacts the web and then varied such that the overall web speed between said web accummulators equals the speed with which the web is driven into and out of said web processing unit.

12. The apparatus of claim 11 in which said adjustable ratio driver provides close running register control by adjusting the phase of the line driver output.

* * * * *